US008025040B1

(12) United States Patent
Aida et al.

(10) Patent No.: US 8,025,040 B1
(45) Date of Patent: Sep. 27, 2011

(54) PLASMA IGNITION SYSTEM

(75) Inventors: Futoshi Aida, Chiyoda-ku (JP); Hiroshi Okuda, Chiyoda-ku (JP); Yusuke Naruse, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/855,937

(22) Filed: Aug. 13, 2010

(30) Foreign Application Priority Data

Apr. 14, 2010 (JP) ..... 2010-093058

(51) Int. Cl.
*H01T 15/00* (2006.01)
*H01T 19/00* (2006.01)

(52) U.S. Cl. ..... 123/143 B

(58) Field of Classification Search ..... 123/143 B
See application file for complete search history.

(56) References Cited

U.S. PATENT DOCUMENTS 4,398,526 A * 8/1983 Hamai et al. ..... 123/606
5,211,142 A * 5/1993 Matthews et al. ..... 123/143 B
5,568,801 A * 10/1996 Paterson et al. ..... 123/598
6,112,730 A * 9/2000 Marrs et al. ..... 123/606
2009/0229581 A1 * 9/2009 Ikeda ..... 123/536

FOREIGN PATENT DOCUMENTS

JP 2009-257112 A 11/2009

* cited by examiner

*Primary Examiner* — Erick Solis
(74) *Attorney, Agent, or Firm* — Sughrue Mion, PLLC

(57) ABSTRACT

To provide a plasma ignition system that can prevent damage on an internal combustion engine due to erroneous ejection of a plasma jet, and further, even when the required voltage of an ignition plug becomes lower, can prevent erroneous ignition by the charged voltage of a PJ capacitor. A plasma power supply circuit of the plasma ignition system includes a voltage-limiting circuit having a first set voltage having an absolute value lower relative to the discharge voltage of the ignition coil, and a second set voltage having an absolute value higher relative to the discharge voltage of the ignition coil, and the first set voltage and the second set voltage are selectively switched according to an operation condition of the internal combustion engine.

3 Claims, 5 Drawing Sheets

PLASMA IGNITION SYSTEM

BACKGROUND OF THE INVENTION

1. Field of the Invention

The present invention relates to a plasma ignition system used for ignition of an internal combustion engine.

2. Description of the Related Art

In a plasma ignition system for an internal combustion engine that ejects a plasma jet into a compressed air-fuel mixture, a large amount of ignition energy can be provided to the compressed air-fuel mixture and ignition performance can be improved, however, in the case where the charged voltage of a PJ (plasma jet) capacitor is extremely small or the like, so-called "failed plasma" may occur in such a way that spark discharge of the ignition plug occurs, but the subsequent plasma discharge does not occur. Further, if the charged voltage of the PJ capacitor is made larger, the failed plasma can be suppressed, but the inconvenience that the current flowing in the ignition plug at plasma discharge becomes larger and the plug life becomes shorter may be caused. As means for sparing the inconvenience, as shown in JP-A-2009-257112, after the start of plasma discharge using spark discharge of the ignition plug as a trigger, the charged voltage of the PJ capacitor may be switched from the high voltage to the low voltage.

The above described plasma ignition system erroneously ejects a plasma jet and causes damage on the internal combustion engine when the ignition plug is erroneously ignited due to external fluctuations because the charged voltage of the PJ capacitor is a higher set voltage as an absolute value relative to the discharge voltage of the ignition coil both at the high voltage and the low voltage. Further, when pressure within the combustion chamber of the internal combustion engine becomes negative, there are problems that the required voltage of the ignition plug becomes lower and the erroneous ignition is caused by the charged voltage of the PJ capacitor.

SUMMARY OF THE INVENTION

In view of the above described problems, a purpose of the invention is to provide a plasma ignition system with increased robustness, i.e., robustness to uncertain external fluctuations and improved function.

According to the invention, in a plasma ignition system including a plasma-discharge ignition plug, an ignition coil that supplies a discharge voltage to the ignition plug based on an ignition signal, and a plasma power supply circuit that is connected in parallel to the ignition plug and supplies electric energy for generation of plasma in a discharge space of the ignition plug at a start of discharge of the ignition plug, the plasma power supply circuit includes a PJ capacitor that is connected in parallel to the ignition plug and supplies the electric energy for discharge and generation of the plasma in the discharge space of the ignition plug at the start of discharge of the ignition plug, a DC/DC converter that is connected to a direct-current power supply and outputs a direct-current voltage for charging of the PJ capacitor, and a voltage-limiting circuit having a first set voltage having an absolute value lower relative to the discharge voltage of the ignition coil, and a second set voltage having an absolute value higher relative to the discharge voltage of the ignition coil, and the first set voltage and the second set voltage are selectively switched according to an operation condition of an internal combustion engine.

According to the plasma ignition system of the invention, when the ignition plug is erroneously ignited due to external fluctuations or the like, erroneous ejection of a plasma jet and the damage on the internal combustion engine can be prevented. In addition, even when the pressure within the combustion chamber of the internal combustion engine becomes negative and the required voltage of the ignition plug becomes lower, erroneous ignition by the charged voltage of the PJ capacitor can be prevented.

The foregoing and other object, features, aspects, and advantages of the present invention will become more apparent from the following detailed description of the present invention when taken in conjunction with the accompanying drawings.

DETAILED DESCRIPTION

Embodiment 1

Figure 1:
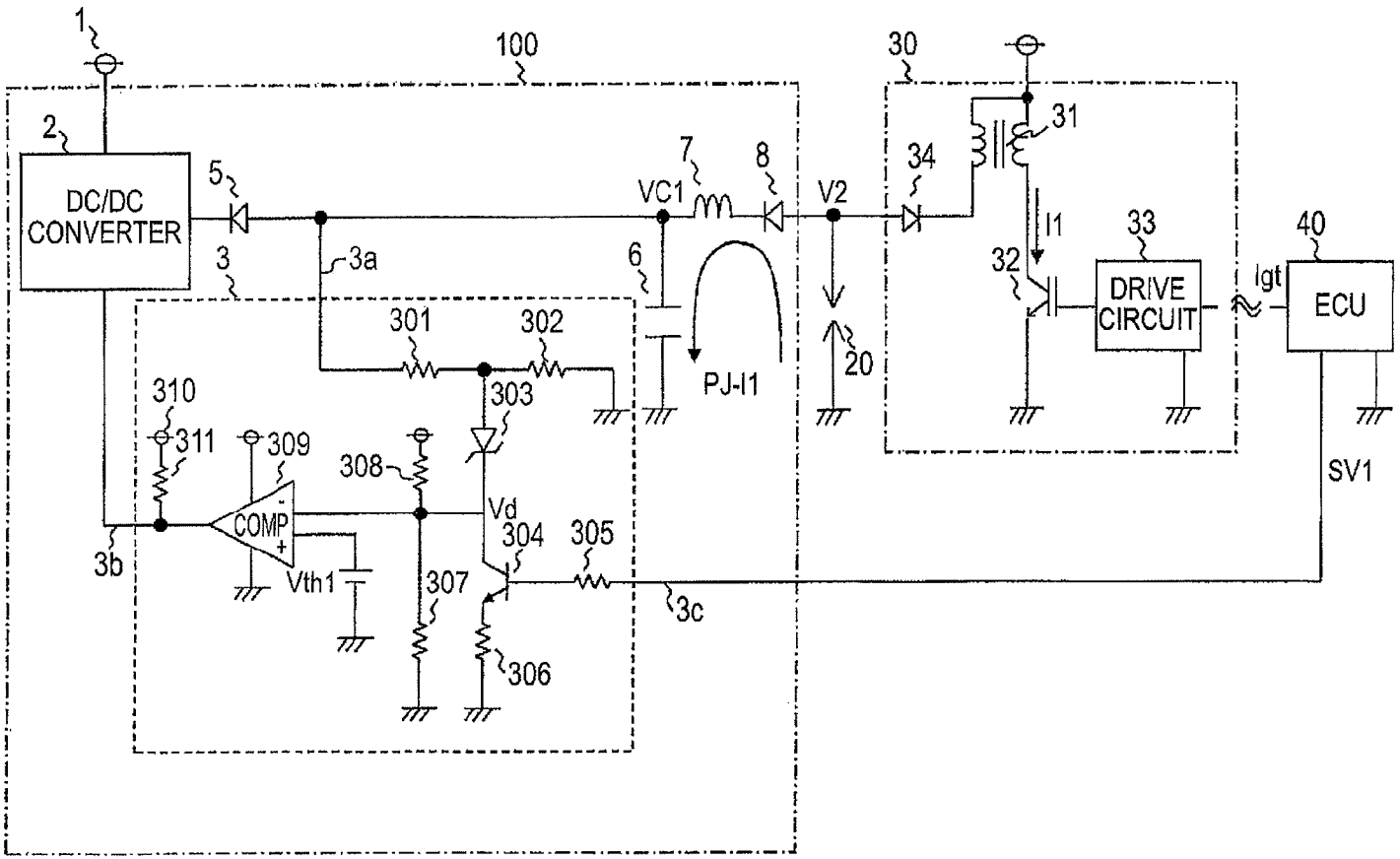
FIG. 1 is a circuit diagram showing a schematic configuration of a plasma ignition system according to embodiment 1 of the invention.

FIG. 1 shows a schematic configuration of a plasma ignition system according to embodiment 1 of the invention.

The plasma ignition system of embodiment 1 includes an ignition plug 20, an ignition circuit 30 that generates a high voltage based on an ignition signal Igt from an ECU 40 for causing discharge in a discharge space of the ignition plug 20, and a plasma power supply circuit 100 that generates a plasma current PJ-I1 for ejecting plasma by providing electric energy into the discharge space in which the impedance has become lower due to the start of discharge of the ignition plug 20. The ignition circuit 30 and the plasma power supply circuit 100 are connected in parallel to the ignition plug 20.

The ignition circuit 30 includes an ignition coil 31, a switching device 32 such as an IGBT connected to a primary coil of the ignition coil 31, a drive circuit 33 that operates the switching device 32 in response to the ignition signal Igt from the ECU 40, and a rectifying diode 34 connected between the secondary coil of the ignition coil 31 and the ignition plug 20.

Further, the ignition circuit drives the switching device 32 via the drive circuit 33 in response to the ignition signal Igt from the ECU 40, switches the first coil current I1 of the ignition coil 31, and thereby, applies a discharge voltage to the ignition plug 20 via the rectifying diode 34.

The plasma power supply circuit 100 characterizing the invention includes a DC/DC converter 2, a voltage-limiting circuit 3, a rectifying diode 5, a PJ capacitor 6, an inductor 7, and a high-voltage diode 8.

The input side of the DC/DC converter 2 is connected to a battery power supply 1, and the output side is connected to the cathode side of the rectifying diode 5. The anode side of the rectifying diode 5 is connected to an input terminal 3*a* of the voltage-limiting circuit 3, the high-voltage side of the PJ capacitor 6, and the inductor 7. The other end of the PJ capacitor 6 is grounded, the other end of the inductor 7 is connected to the cathode side of the high-voltage diode 8, and the anode side of the high-voltage diode 8 is connected to the ignition plug 20.

Here, a first set voltage VCL1 of the voltage-limiting circuit 3 is set lower as an absolute value relative to a discharge voltage V2A of the ignition coil 31, and a second set voltage VCL2 is set higher as an absolute value relative to the discharge voltage V2A of the ignition coil 31.

In a period in which a low voltage signal is input from the ECU 40 to an input terminal 3*c* of the voltage-limiting circuit 3 as a control command signal SV1 according to the operation condition of the internal combustion engine, a transistor 304 within the voltage-limiting circuit 3 is in OFF-state, and a comparator 309 compares a detected voltage Vd obtained by detection of the charged voltage VC1 of the PJ capacitor 6 using resistors 301, 302, 307, 308 and a zener diode 303 with a reference voltage Vth1. In the comparator 309, when the detected voltage Vd is less than the reference voltage Vth1, that is, the charged voltage VC1 of the PJ capacitor 6 becomes the first set voltage VCL1, a voltage detection signal at High-level is supplied from an output terminal 3*b* of the voltage-limiting circuit 3 to the DC/DC converter 2. Thereby, the operation of the DC/DC converter 2 is stopped.

Further, in a period in which a high voltage signal is input from the ECU 40 to the input terminal 3*c* of the voltage-limiting circuit 3 as the control command signal SV1, the transistor 304 within the voltage-limiting circuit 3 is in ON-state, and the comparator 309 compares a detected voltage Vd obtained by detection of the charged voltage VC1 of the PJ capacitor 6 using the resistors 301, 302, 306, 307, 308 and the zener diode 303 with the reference voltage Vth1. In the comparator 309, when the detected voltage Vd is less than the reference voltage Vth1, that is, the charged voltage VC1 of the PJ capacitor 6 becomes the second set voltage VCL2, a voltage detection signal at High-level is supplied from the output terminal 3*b* of the voltage-limiting circuit 3 to the DC/DC converter 2. Thereby, the operation of the DC/DC converter 2 is stopped.

Figure 2:
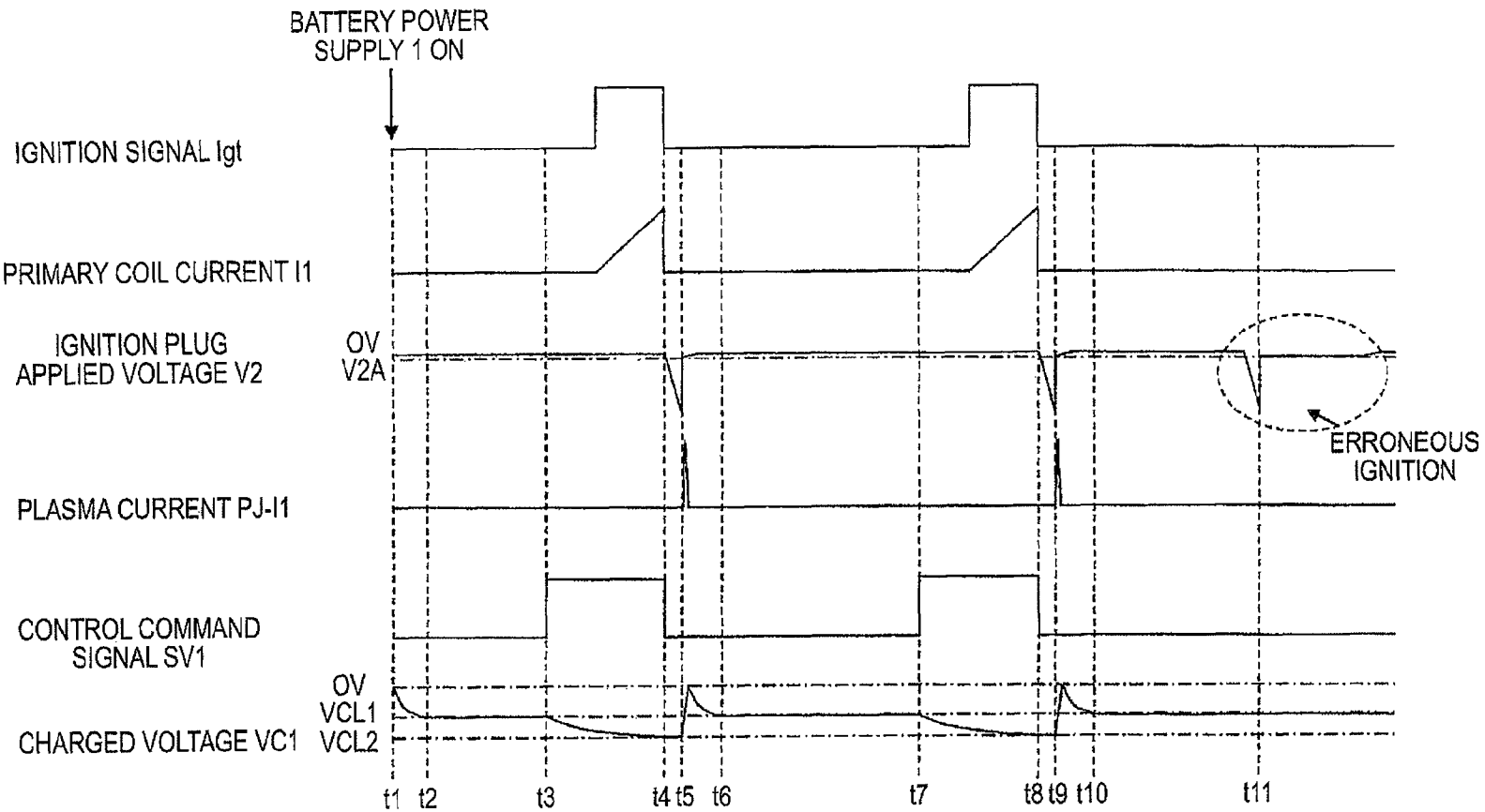
FIG. 2 is a timing chart at respective operation points in embodiment 1.

FIG. 2 is a timing chart regarding waveforms of the respective parts in the embodiment 1.

At time t1, when the battery power supply 1 is turned on, the DC/DC converter 2 within the plasma power supply circuit 100 starts operation and charges the PJ capacitor 6. Concurrently, the low control command signal SV1 is output from the ECU 40 according to the operation condition of the internal combustion engine, and the set voltage of the plasma power supply circuit 100 becomes the first set voltage VCL1 of the voltage-limiting circuit 3 as described above.

At time t2, when the charged voltage VC1 of the PJ capacitor 6 reaches the first set voltage VCL1 of the voltage-limiting circuit 3, the operation of the DC/DC converter 2 is stopped.

At time t3 (for example, set to several milliseconds before rising of the ignition signal Igt), when the high control command signal SV1 is output from the ECU 40 according to the operation condition of the internal combustion engine, the set voltage of the plasma power supply circuit 100 becomes the second set voltage VCL2 of the voltage-limiting circuit 3 as described above.

Thereby, the operation of the DC/DC converter 2 is restarted and, at time t4 (for example, set at the same time with the falling of the ignition signal Igt), when the charged voltage VC1 of the PJ capacitor 6 reaches the second set voltage VCL2 of the voltage-limiting circuit 3, the operation of the DC/DC converter 2 is stopped. Further, at time t4, the low control command signal SV1 is output from the ECU 40 according to the operation condition of the internal combustion engine, and the set voltage of the plasma power supply circuit 100 becomes the first set voltage VCL1 of the voltage-limiting circuit 3 as described above.

Note that, since the charged voltage |VC1| of the PJ capacitor 6>|VCL1| at time t4, the operation of the DC/DC converter 2 is in the stopped state.

At time t5, a high voltage V2 is applied to the ignition plug 20 and causes breakdown, and electric energy is provided from the plasma power supply circuit 100 into the discharge space in which the impedance has become lower due to the start of discharge, and the plasma current PJ-I1 flows for ejecting plasma. When the plasma current PJ-I1 flows, the charge charged in the PJ capacitor 6 is removed and the charged voltage VC1 becomes 0 V. Thereby, the charged voltage |VC1| of the PJ capacitor 6<|VCL1|, and the operation of the DC/DC converter 2 is restarted. Afterward, the same operation is repeated from times t6 to t10.

Then, the ignition plug 20 is erroneously ignited due to external fluctuations at time t11, however, the high-voltage diode 8 does not break or the plasma current PJ-I1 does not flow in the ignition plug 20 because the charged voltage VC1 (=VCL1) of the PJ capacitor 6<V2A (the discharge voltage of the ignition coil 31).

Further, even when pressure of the ignition plug 20 becomes negative and the required voltage becomes lower, in the period in which the low control command signal SV1 is output from the ECU 40, the charged voltage VC1 of the PJ capacitor 6=VCL1, and thus, no erroneous ignition occurs.

In FIG. 1, the example in which the high-voltage diode 8 and the rectifying diode 34 are arranged in a direction in which the center electrode of the ignition plug 20 is an anode, however, the high-voltage diode 8 and the rectifying diode 34 may be arranged in a direction in which the center electrode of the ignition plug 20 is a cathode.

As described above, according to the invention, in the plasma ignition system including the plasma-discharge ignition plug 20, the ignition coil 31 that supplies the discharge voltage to the ignition plug 20 based on the ignition signal, and the plasma power supply circuit 100 that is connected in parallel to the ignition plug 20 and supplies the electric energy for generation of the plasma in the discharge space of the ignition plug 20 at the start of discharge of the ignition plug 20, the plasma power supply circuit 100 includes the PJ capacitor 6 that is connected in parallel to the ignition plug 20 and supplies the electric energy for discharge and generation of the plasma in the discharge space of the ignition plug 20 at the start of discharge of the ignition plug 20, the DC/DC converter 2 that is connected to the direct-current power supply 1 and outputs the direct-current voltage for charging of the PJ capacitor 6, and the voltage-limiting circuit 3 having the first set voltage VCL1 having the absolute value lower relative to the discharge voltage of the ignition coil 31, and the second set voltage VCL2 having the absolute value higher relative to the discharge voltage of the ignition coil 31, and the first set voltage VCL1 and the second set voltage VCL2 are selectively switched according to the operation condition of the internal combustion engine. Thereby, even when the ignition plug 20 is erroneously ignited due to external fluctuations or the like, erroneous ejection of the plasma jet can be prevented and the damage on the internal combustion engine can be prevented. In addition, even when the pressure within the combustion chamber of the internal combustion engine becomes negative and the required voltage of the ignition plug 20 becomes lower, erroneous ignition by the charged voltage VC1 of the PJ capacitor 6 can be prevented.

Embodiment 2

Figure 3:
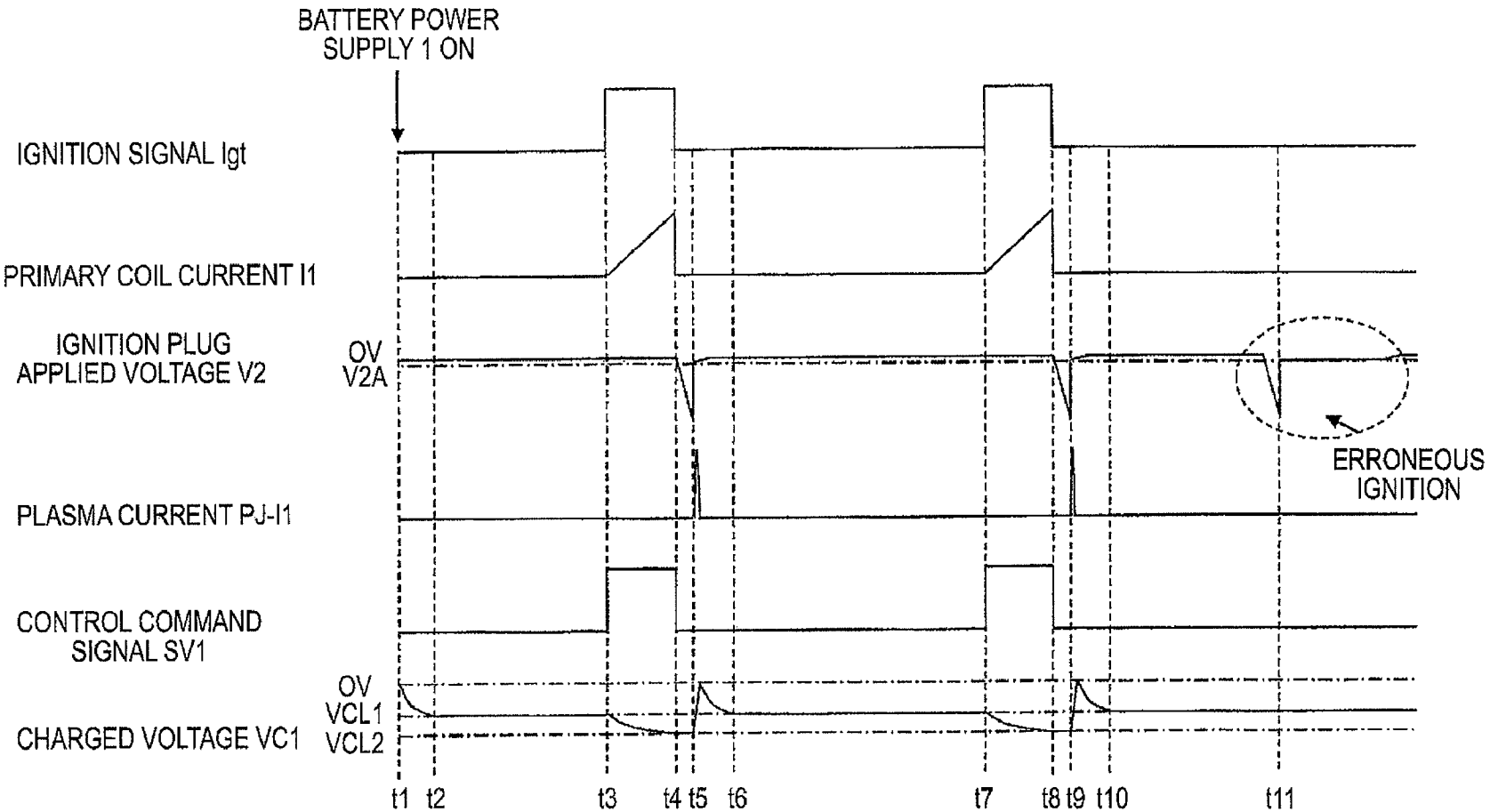
FIG. 3 is a timing chart at respective operation points in embodiment 2.

A plasma ignition system according to embodiment 2 of the invention is, in the configuration of embodiment 1, characterized in that the control command signal SV1 output from the ECU 40 is synchronized with the ignition signal Igt as shown in FIG. 3, and the operation principle is the same as that in embodiment 1 and the explanation will be omitted.

According to the embodiment 2, in a period in which the ignition signal Igt is not supplied, the first set voltage VCL1 of the voltage-limiting circuit 3 is selected, and, in a period in which the ignition signal Igt is supplied, the second set voltage VCL2 is selected, and thereby, even when the ignition plug 20 is erroneously ignited due to external fluctuations or the like, erroneous ejection of the plasma jet can reliably be prevented and the damage on the internal combustion engine can be prevented. In addition, even when the pressure within the combustion chamber of the internal combustion engine becomes negative and the required voltage of the ignition plug 20 becomes lower, erroneous ignition by the charged voltage VC1 of the PJ capacitor 6 can reliably be prevented.

Embodiment 3

Figure 4:
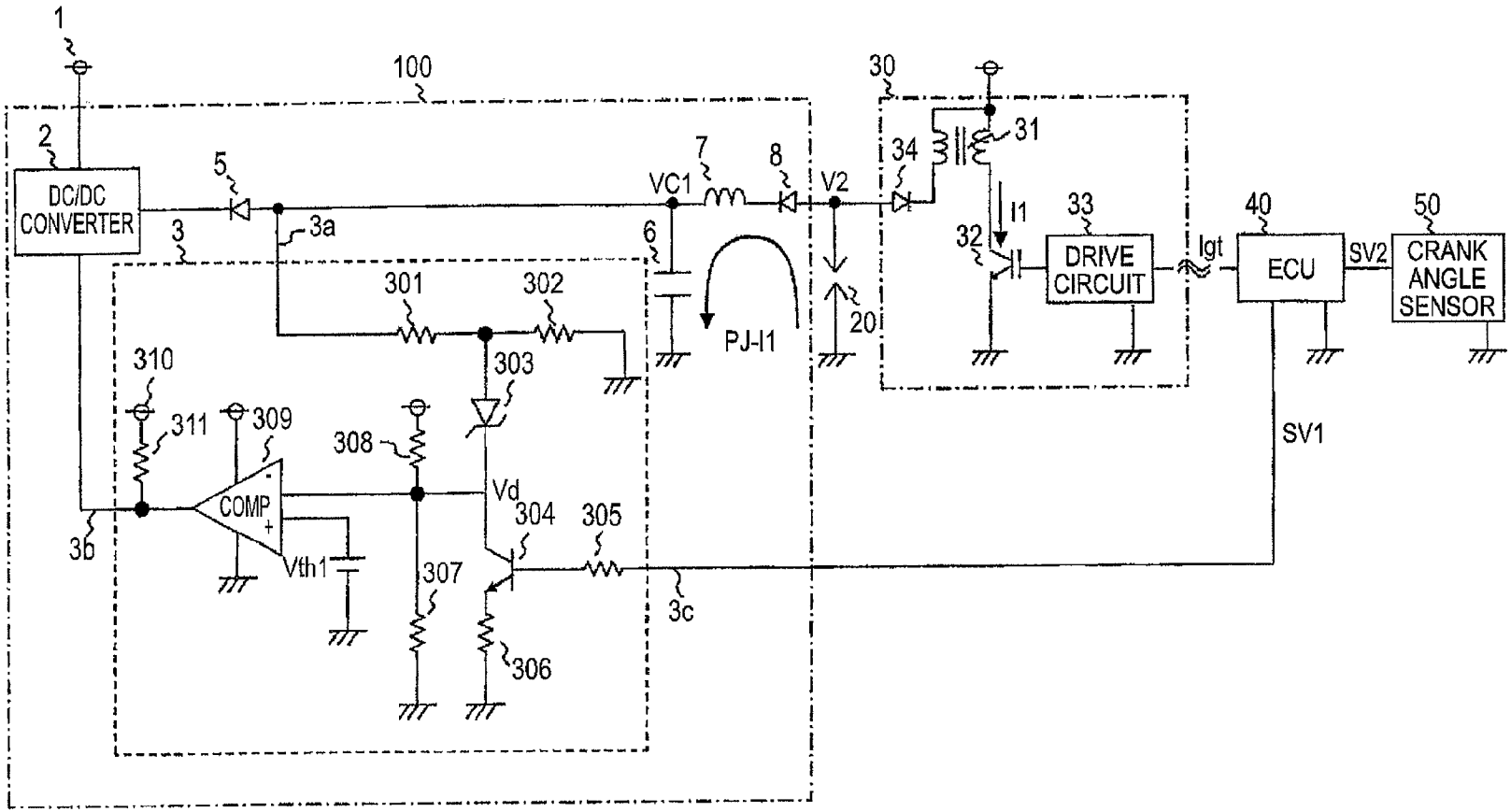
FIG. 4 is a circuit diagram showing a schematic configuration of a plasma ignition system according to embodiment 3.

FIG. 4 shows a schematic configuration of a plasma ignition system according to embodiment 3 of the invention.

Figure 5:
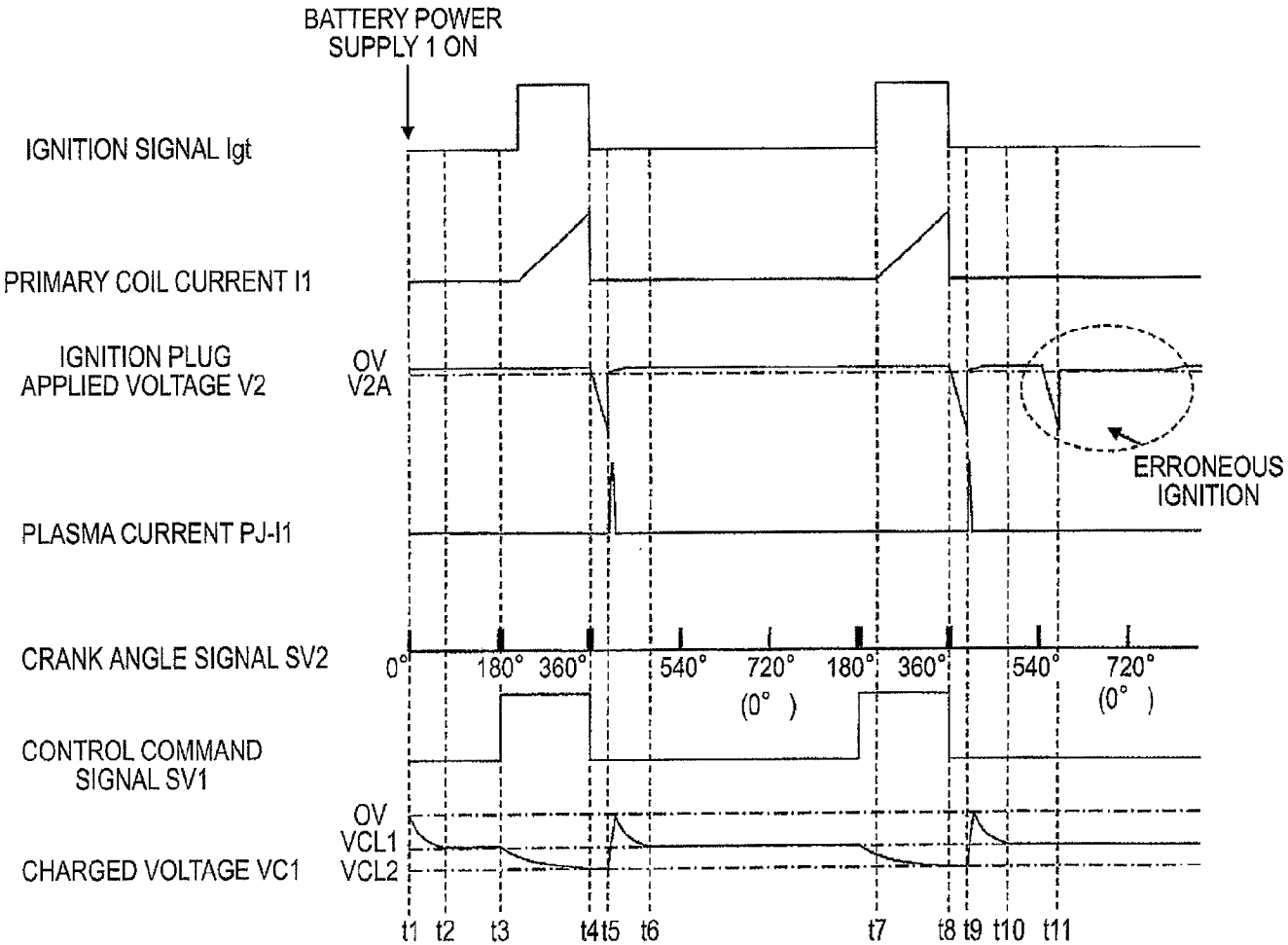
FIG. 5 is a timing chart at respective operation points in embodiment 3.

In the plasma ignition system according to the embodiment 3, when a crank angle sensor 50 is connected to the ECU 40 and an air intake step (CA: 0° to 180°), a compression step (CA: 180° to 360°), a combustion step (CA: 360° to 540°), and an exhaust step (CA: 540° to 720°) of the internal combustion engine are provided, in the configuration of embodiment 1, the ECU 40 outputs the high control command signal SV1 only in the period of the compression step (CA: 180° to 360°) based on a crank angle signal SV2 supplied from the crank angle sensor 50 to the ECU 40. FIG. 5 is a timing chart thereof. The operation principle is the same as that in embodiment 1 and the explanation will be omitted.

According to embodiment 3, only in the period of the compression step of the internal combustion engine, the second set voltage VCL2 of the voltage-limiting circuit 3 is selected, and thereby, even when the ignition plug 20 is erroneously ignited due to external fluctuations or the like, erroneous ejection of the plasma jet can reliably be prevented and the damage on the internal combustion engine can be prevented. In addition, even when the pressure within the combustion chamber of the internal combustion engine becomes negative and the required voltage of the ignition plug 20 becomes lower, erroneous ignition by the charged voltage VC1 of the PJ capacitor 6 can reliably be prevented.

Various modifications and alterations of this invention will be apparent to those skilled in the art without departing from the scope and spirit of this invention, and it should be understood that this is not limited to the illustrative embodiments set forth herein.

What is claimed is:

1. A plasma ignition system comprising:

a plasma-discharge ignition plug;

an ignition coil that supplies a discharge voltage to the ignition plug based on an ignition signal; and a plasma power supply circuit that is connected in parallel to the ignition plug and supplies electric energy for generation of plasma into a discharge space of the ignition plug at a start of discharge of the ignition plug, wherein the plasma power supply circuit includes a plasma jet capacitor that is connected in parallel to the ignition plug and supplies the electric energy for discharge and generation of the plasma in the discharge space of the ignition plug at the start of discharge of the ignition plug, a DC/DC converter that is connected to a direct-current power supply and outputs a direct-current voltage for charging of the plasma jet capacitor, and a voltage-limiting circuit having a first set voltage having an absolute value lower relative to the discharge voltage of the ignition coil, and a second set voltage having an absolute value higher relative to the discharge voltage of the ignition coil, and wherein the first set voltage and the second set voltage are selectively switched according to an operation condition of an internal combustion engine.

2. The plasma ignition system according to claim 1, wherein, in a period in which the ignition signal is not supplied, the first set voltage is selected, and, in a period in which the ignition signal is supplied, the second set voltage is selected.

3. The plasma ignition system according to claim 1, wherein, only in a period of a compression step of the internal combustion engine, the second set voltage is selected.

* * * * *